United States Patent [19]

Okamura et al.

[11] Patent Number: 4,563,101

[45] Date of Patent: Jan. 7, 1986

[54] PRINTER

[75] Inventors: Yasushi Okamura; Kiichiro Tanaka, both of Fukuoka, Japan

[73] Assignee: Matsushita Electric Industrial Co., Ltd., Kadoma, Japan

[21] Appl. No.: 649,988

[22] Filed: Sep. 11, 1984

Related U.S. Application Data

[63] Continuation of Ser. No. 402,805, Jul. 28, 1982, abandoned.

[51] Int. Cl.[4] ..... B41J 13/12

[52] U.S. Cl. ..... 400/603; 400/636.2

[58] Field of Search ..... 400/568, 569, 595, 596, 400/600, 600.3, 601, 603, 604, 636.2, 692; 339/64 R, 64 M

[56] References Cited

U.S. PATENT DOCUMENTS

| | | | |
|---|---|---|---|
| 881,126 | 3/1908 | Hutches, Jr. | 400/636.2 X |
| 968,261 | 8/1910 | Platt | 339/64 R |
| 1,104,504 | 7/1914 | Holliday | 400/636.2 X |
| 2,351,854 | 6/1944 | Hall | 400/603 X |
| 2,871,457 | 1/1959 | Jencks et al. | 339/64 M X |
| 2,944,240 | 7/1960 | Barber | 339/64 M |

FOREIGN PATENT DOCUMENTS

| | | |
|---|---|---|
| 2707845 | 9/1977 | Fed. Rep. of Germany . |
| 7911289 | 4/1979 | Fed. Rep. of Germany . |
| 118740 | 3/1976 | German Democratic Rep. . |
| 243855 | 2/1947 | Switzerland . |

OTHER PUBLICATIONS

USAC Electronics Industry Co., Ltd. Literature.

*Primary Examiner*—Edgar S. Burr
*Assistant Examiner*—Charles A. Pearson
*Attorney, Agent, or Firm*—Cushman, Darby & Cushman

[57] ABSTRACT

A card inserter 1 is detachably mounted on a main part 14 of a printer, by making catchings of pins 32 and 27 on the main part by hooks 31 and 24 of the left and right guide post 10 and 11. After mounting of the card inserter 1, an idler gear 17 links the platen gear 16 and the driving gear 18 for card driving shaft 13. At the same time the connector, consisting of a plug 33' is connected to a receptacle 35 thereby to complete an electric circuit connection between the main part 14 and the card inserter 1.

1 Claim, 7 Drawing Figures

PRINTER

This is a continuation of application Ser. No. 402,805, filed July 28, 1982, now abandoned.

BACKGROUND OF THE INVENTION

1. Field of the Invention

The present invention relates to a printer suitable for use in business machines such as computer output stages for printing on fanfold papers or web papers as well as on, by use of a card inserter or adapter to be mounted on a main part, on piece sheets or cards.

2. Description of the Prior Art

In conventional printers for use in business machines such as output stages of computers, the printers have been generally constructed usable for fanfold papers or web papers by the main part, and for a piece or sheets or cards by use of an inserter or adapter to be mounted on the main part, the inserter comprising its own electric motor for operating the feeding or discharge of the piece or sheets or a card for printing. Since the electric motor has considerable weight, the card inserter has been so heavy, as for example 7 kg, that it is not easy for a female machine operator to mount the card inserter on the main part and detach it from the main part.

SUMMARY OF THE INVENTION

Therefore, the present invention relates to an improvement in a printer for use in business machines, and it is an object of the invention to provide a printer comprising a drastically light weight card inserter.

The printer in accordance with the present invention comprises:

a main part comprising a platen rotatably held by a platen shaft, a driving means for driving the platen shaft responsive to input signal thereto, a printing head for printing on a recording sheet held on the platen, a card inserter having a frame means to be detachably mounted on the main part, a card feeding means held by the frame means, a driving force coupling means for mechanical coupling between the motion of the platen shaft and the card feeding means when the frame means is mounted on the main part, and a fixing means for fixing the frame means on the main part when rightly mounted.

DESCRIPTION OF THE PREFERRED EMBODIMENTS

Figure 1:
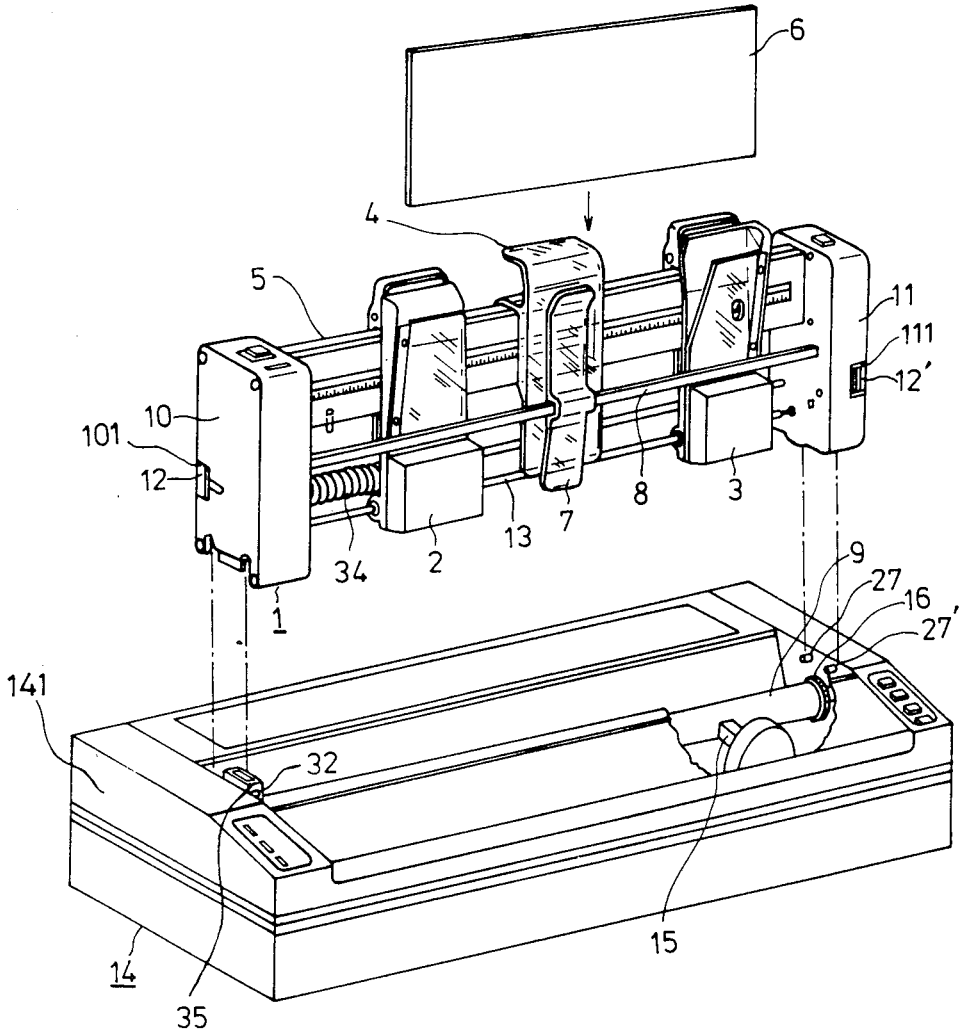
FIG. 1 is a perspective view of a printer embodying the present invention with its card inserter detached upward from the main part for easier understanding.
Figure 2:
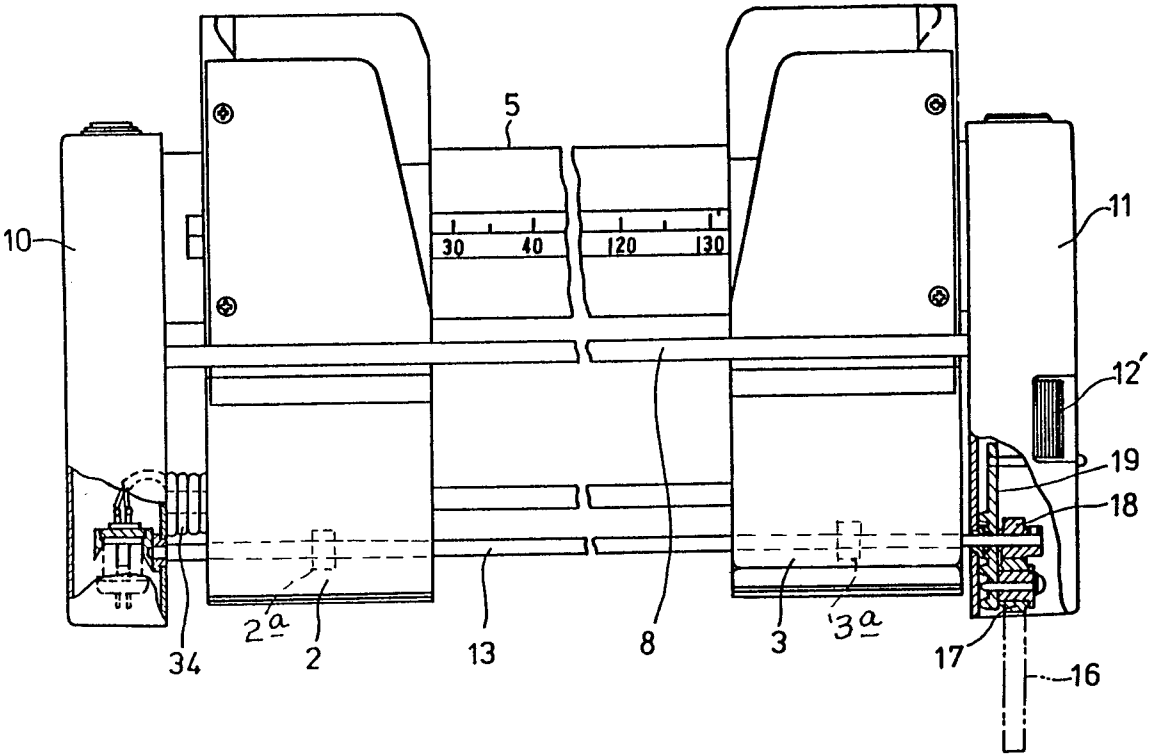
FIG. 2 is an abridged front view of the card inserter of FIG. 1.

FIG. 1 is a perspective view showing overall construction of a printer in accordance with the present invention. The printer comprises a main part 14 having a platen 9 held rotatably by a shaft (not shown) to a casing 141 and a printing head 15, which is laterally movable with respect to the platen 9. The printer includes drive means, such as an electric motor (not shown), connected to the shaft by a platen gear 16 of the platen 9. The printer main part 14 further has engaging pins 27, 27' and 32. The card inserter 1 has a left guide post 10 and a right guide post 11, which are to be mounted on left or right end part of the casing or frame of the main part 14. Both guide posts 10 and 11 are connected by guide rail 5 and a front guide rail 8, thereby forming a frame means. A left pocket 2, and a right pocket 3 which contain a driving roller therein shown diagramatically in FIG. 2 in dotted line at 2*a* and 3*a*, respectively, and a rear guide 4 are each held laterally movable along the guide rail 5, so that they are adjusted response to width of cards to be printed. A front guide 7 is held laterally movable along the front guide rail 8. The front guide 7 and the rear guide 4 are for guiding cards thereby. Small handles 12 and 12' are provided in windows 101 and 111 of the left guide post 10 and the right guide post 11. The right guide post 11 contains drive linkage for driving a drive shaft 13 by engagement with the platen gear 16 with drive shaft 13 passing through pockets 2 and 3 to drive the drive rollers therein.

Figure 3:
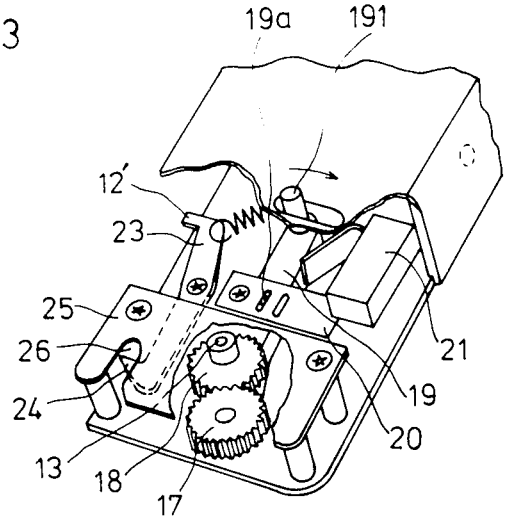
FIG. 3 is a perspective view of a part of a right part of the card inserter.
Figure 4:
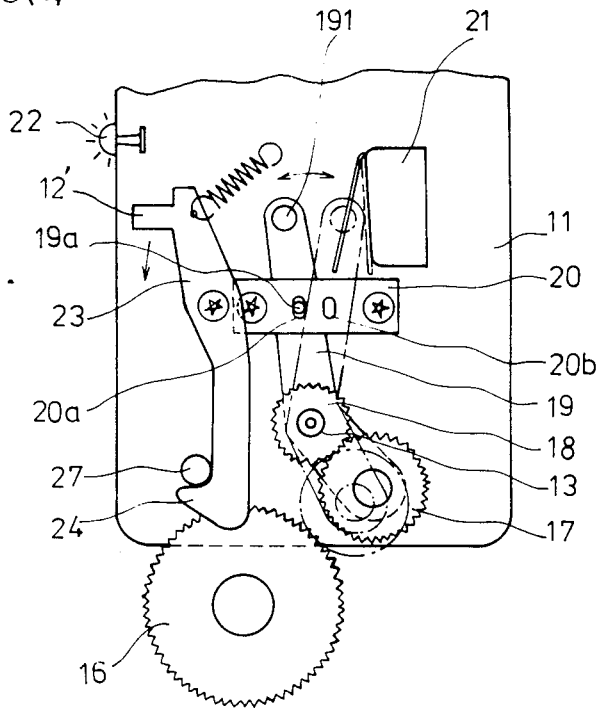
FIG. 4 is a side view showing coupling of the right part and the main part.
Figure 6:
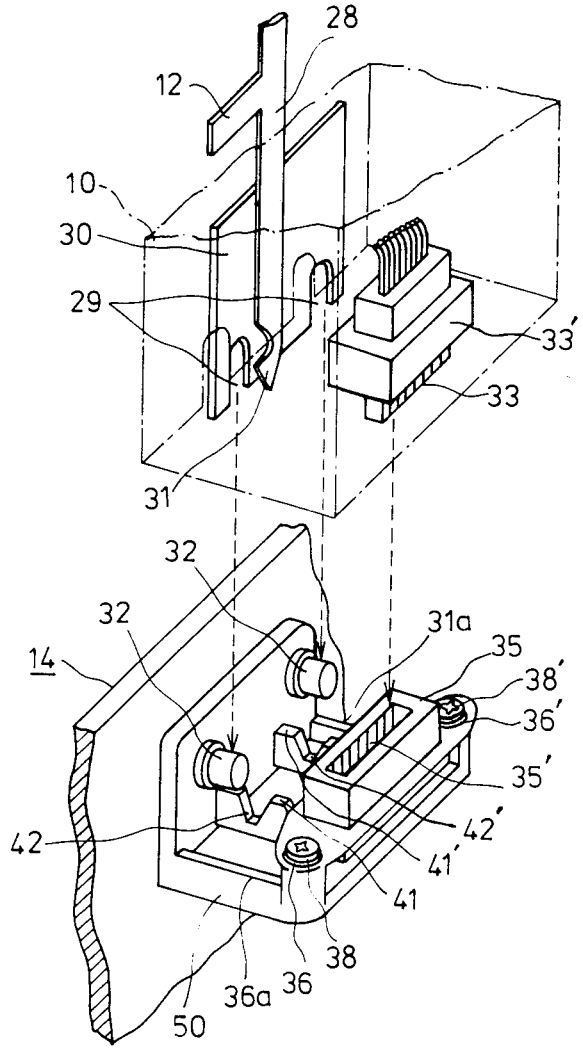
FIG. 6 is an enlarged perspective view of the connector of FIG. 5.

The drive link in the right guide post 11 is shown in FIG. 3 and FIG. 4. The right guide post has a drive shaft gear 18 for driving the drive shaft 13 and an idler gear 17 for linking between the platen gear 16 of the main part 14 and the drive shaft gear 18. When the card inserter 1 is correctly mounted on the main body 14, and an operation switch lever 19 is turned clockwise, then the idler gear 17 couples the platen gear 16, thereby transmitting rotation of the platen gear 16 to the driving shaft 13, and driving the card driving roller (not shown). The right guide post 11 and the left guide post 10 have coupling levers 23 and 28 having coupling hooks 24 and 31, and small handles 12' and 12 and fulcrumed on the guide posts 11 and 10 as shown in FIG. 4 and FIG. 6, respectively. The levers 23 and 28 are pulled by springs and catch pins 27 and 32', shown in FIG. 4 and FIG. 6, of the main part 14 when the card inserter 1 is rightly disposed on the main part 14. The operation switch lever 19 is fulcrumed at the driving shaft 13, has a stop position stabilizing protrusion 19*a* which is to be engaged in a hole 20*a* or 20*b*. The operation switch lever 19 is switched to a card printing operation by turning it clockwise as shown by dot line in FIG. 4 by handling a pin 191, and to a fanfold paper printing operation by turning it counterclockwise. The upper end of the switch lever 19 pushes the actuator of a small switch 21, which switches a LED 22 on. The lower end of the switch lever 19 rotatably holds the idler gear 17, thereby moving it to an engaging position by the clockwise turning of the switch lever 19.

Figure 5:
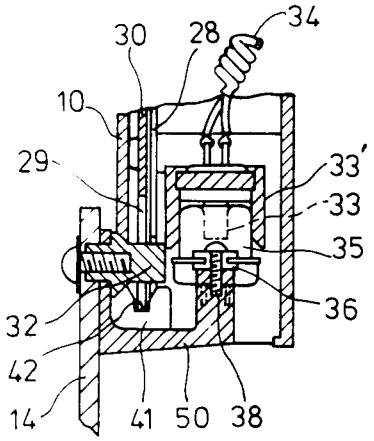
FIG. 5 is a front view of an electric connector of a left part of the card inserter.
Figure 7:
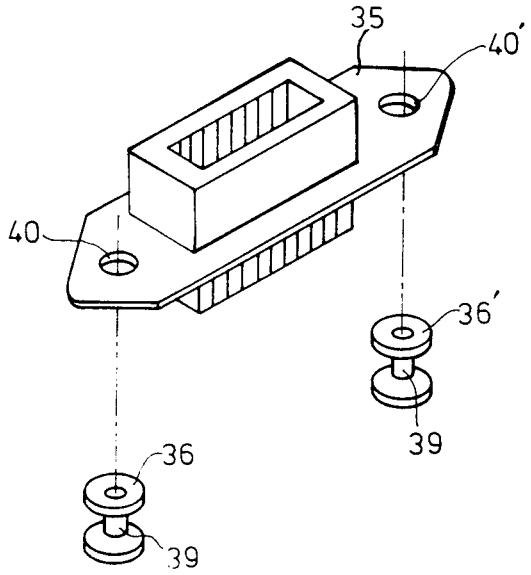
FIG. 7 is a perspective view of a receptacle of the connector with a specially designed mounting bushing.

FIG. 5, FIG. 6 and FIG. 7 show the electric connector 33' inside the left guide post 10, the connector 33' being for connection to a receptacle 35 provided on a part of the main part 14. When the card inserter is mounted in position on the main part 14 of the printer, pins 32, 32 on the inner wall of the main part 14 are received by recesses 29, 29 and one of the pins 32 is caught by the hook 31 of the lever 28. Then, a male connector or a plug 33' having a number of electric contacts 33 provided inside the left post guide 10 is inserted in the receptacle 35 having corresponding contacts 35' therein. The receptacle 35 is adjustably held on the main part 14. The adjustability of receptacle 35 is made possible through the use of rubber or elastic bushings 36 and 36' each of which have a pair of large collars and a thin neck portion 39 inbetween which are loosely engaged in large holes 40 and 40' of the receptacle. Since the bushings 36, 36' loosely engage holes 40, 41', even though the bushings 36, 36' are fixed by screws 38, 38' or rivetts on a frame receptacle holder 50, the receptacle 35 can move a small distance so that it can easily receive the contacts 33 of the plug 33' therein. Thus the plug 33' and the receptacle make a reliable connection. Furthermore, the cover of the plug 33' is formed so as to cover the receptacle 35 thereby firmly securing the connection. The plug 33' is fixed on a guide member 30, which is adjustably mounted in the left post guide 10. The outside edges of the receptacle holder 50 form a guide for mounting the box like cover of the left guide post 10 there around. Furthermore, the receptacle holder 50 has V-shaped recess parts 42, 42' for receiving the guide member 30 therein. Therefore, by insertion in the V-shaped recesses 42, 42', the guide member 30 is rightly adjusted of its position and guides the plug 33' for easy coupling to the receptacle 35. One end of a curled cord 34 is connected to the plug 33', and the other end of the curled cord 34 is connected to the LED 22 and to the left pocket 2 so as to be connected to, e.g. a sensor (not shown) therein.

Card printing by using the card inserter is now elucidated. First the card inserter 1 is mounted on the main part 14 by putting the left guide post 10 on the receptacle holder 50. Then by the insertion of the bottom edge of the guide member 30 into the V-shaped recesses 42, 42' and by receiving the pins 32 in the recesses 29 of the guide member 30, the guide member is put in a right position with respect to the receptacle holder 50. Therefore the plug 33' is easily connected to the receptacle by utilizing adjustability of the latter by means of the loose fit between the bushing and the large holes 40, 40'. At the same time the hooks 31 in the left guide post 10 and the hook 24 in the right guide post 11 catch the pins 32 and 27, respectively and fix the card inserter 1 on the main part 14. Then by turning the switch lever 19 clockwise, the driving gear 18 is linked with the platen gear 16, and rotary motion is transmitted to the driving shaft 13 of the card inserter. Since the idler gear 17 is provided on a fulcrumed lever 19, positional errors with respect to the platen gear 16 and the idler gear 17 can be adjusted.

Since the driving shaft 13 is linked by the gears 18, 17 and 16 to the platen shaft motion, there is no need to provide an electric motor in the card inserter 1, and therefore, the size and weight of the card inserter is drastically reduced, such that from the conventional card inserter averagely weighing 7 kg to only 1.7 kg in the preferred embodiment apparatus, and also the price of the card inserter is reduced.

For removal of the card inserter 1 from the main part 14, only pushing the small handles 12 and 12' downwards to release catchings of the pins 32 and 27 respectively and pull-up the card inserter 1 is enough.

What is claimed is:

1. A printer comprising:

a main part comprising a platen rotatably held by a platen shaft, an electrical system for controlling operation of the printer, a driving means for driving said platen shaft responsive to input signals thereto, a printing head for printing on a recording sheet held on said platen, a card feeding means for feeding cards to said printer, said card feeding means including frame means for being detachably mounted on said main part, said frame means including a pair of posts at opposite ends thereof, a drive shaft rotatably mounted to and extending between said pair of posts, driving force coupling means positioned in one of said pair of posts for effecting mechanical coupling between the motion of said platen shaft and said drive shaft when said frame means is mounted on said main part, electrical coupling means positioned in the other of said pair of posts for coupling said card feeding means directly to the electrical system of said printer, said electrical coupling means including a receptacle having means defining relatively large openings at each end thereof, said receptacle being mounted in a loose fashion by elastic bushings positioned within said relatively large opernings and being secured to said printer so that the receptacle is movable and a connector mounted to said card feeding means, said connector and receptacle each having electric contacts, and fixing means positioned in each of said pair of posts for fixing said frame means to said main part when mounted thereon, wherein one of said posts being formed on the right side of said frame means and having a substantially hollow interior for receiving said driving force coupling means therein so that said driving force coupling means fit over and engage said platen shaft driving means, and the other of said posts being formed on the left side of said frame means and having a substantially hollow interior portion for receiving said connector portion of said electric coupling means wherein the loose mounting of said receptacle allows horizontal movement so that coupling between the electric contacts of said connector and said receptacle can easily mesh together when said card feeding means is mounted on said main part, said frame member further including front and rear guide rail members connected to and extending between said pair of posts, first and second guide members slidingly positioned on said rear guide rail, each of said first and second guide members having a lower pocket portion containing a driving roller drivingly engaged about said drive shaft, a rear guide member slidingly positioned on said rear guide rail and in between said first and second guide members and a front guide member slidingly positioned on said front guide rail wherein said driving force coupling means comprises an idler gear which is rotatably borne on a switchable lever, said one of said pair of posts including means defining a slot in the side thereof, said lever including means extending outwardly thereof and through said slot means so as to allow movement of said lever between at least first and second positions, said idler gear providing engagement between a platen gear of said main part and a driving gear for driving said drive shaft when the lever is in one of its first or second positions.

* * * * *